US009956780B2

(12) United States Patent
Nanba et al.

(10) Patent No.: US 9,956,780 B2
(45) Date of Patent: May 1, 2018

(54) ELECTRONIC DEVICE, LIQUID EJECTING HEAD, AND MANUFACTURING METHOD OF ELECTRONIC DEVICE

(71) Applicant: SEIKO EPSON CORPORATION, Tokyo (JP)

(72) Inventors: Toshinari Nanba, Sakata (JP); Tomoyoshi Saito, Chino (JP); Shuichi Tanaka, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/245,002

(22) Filed: Aug. 23, 2016

(65) Prior Publication Data

US 2017/0057222 A1 Mar. 2, 2017

(30) Foreign Application Priority Data

Aug. 25, 2015 (JP) ..... 2015-165507

(51) Int. Cl.
*B41J 2/14* (2006.01)
*B41J 2/16* (2006.01)

(52) U.S. Cl.
CPC ..... *B41J 2/1623* (2013.01); *B41J 2/14233* (2013.01); *B41J 2/161* (2013.01); *B41J 2/1626* (2013.01); *B41J 2/1631* (2013.01); *B41J 2/1632* (2013.01); *B41J 2/14072* (2013.01); *B41J 2002/14362* (2013.01); *B41J 2002/14491* (2013.01); *B41J 2202/18* (2013.01)

(58) Field of Classification Search
CPC .. B41J 2/1623; B41J 2/14233; B41J 2202/18; B41J 2/14072; B41J 2002/14362; B41J 2002/14491
See application file for complete search history.

(56) References Cited

U.S. PATENT DOCUMENTS

2015/0231882 A1* 8/2015 Yoda ..... B41J 2/1433 347/50

FOREIGN PATENT DOCUMENTS

| | | |
|---|---|---|
| JP | 2012-106386 | 6/2012 |
| JP | 2014-151537 | 8/2014 |

* cited by examiner

*Primary Examiner* — Geoffrey Mruk
(74) *Attorney, Agent, or Firm* — Workman Nydegger

(57) ABSTRACT

An electronic device includes a first substrate including a structure body protruded from one surface; and a second substrate stacked and disposed facing the one surface through a spacer, in which the first substrate and the spacer are bonded to each other by an adhesive, and in which the adhesive is extended up to the structure body along the one surface.

10 Claims, 9 Drawing Sheets

ELECTRONIC DEVICE, LIQUID EJECTING HEAD, AND MANUFACTURING METHOD OF ELECTRONIC DEVICE

The entire disclosure of Japanese Patent Application No: 2015-165507, filed Aug. 25, 2015 is expressly incorporated by reference herein in its entirety.

BACKGROUND

1. Technical Field

The present invention relates to an electronic device in which a first substrate and a second substrate are bonded to each other by an adhesive with a spacer interposed therebetween, a liquid ejecting head, and a manufacturing method of the electronic device.

2. Related Art

The electronic device is a device including a drive element such as a piezoelectric element and the like, and is applied in various liquid ejecting devices, a pressure and vibration sensor, or the like. For example, in the liquid ejecting device, various types of liquid are ejected from a liquid ejecting head using the electronic device. As the liquid ejecting device, for example, there is an image recording device such as an ink jet printer, an ink jet plotter, or the like. However, recently, the liquid ejecting device has also been applied in various manufacturing devices using characteristics thereof in which a very small amount of liquid can be accurately landed at a predetermined position. For example, the liquid ejecting device is applied in a display manufacturing apparatus for manufacturing a color filter of a liquid crystal display or the like, an electrode forming apparatus for forming an electrode of an organic electro luminescence (EL) display, a field emitting display (FED), or the like, and a chip manufacturing apparatus for manufacturing a bio-chip (biological and chemical element). Accordingly, a recording head for the image recording device ejects liquid ink, and a coloring material ejecting head for a display manufacturing device ejects the solutions of coloring materials of red (R), green (G), and blue (B). In addition, an electrode material ejecting head for the electrode forming apparatus ejects a liquid electrode material, and a bio-organic material ejecting head for the chip manufacturing apparatus ejects the solution of a bio-organic material.

The liquid ejecting head includes the electronic device in which a plurality of substrates are stacked. In addition, in the semiconductor package of micro electro mechanical systems (MEMS) of various sensors or the like, a structure in which substrates are stacked in a state where the substrates are spaced away from each other by the spacer such as the photosensitive resin and the like in order to correspond to the high density and miniaturization of wiring, is adopted. For example, in a liquid ejecting head disclosed in JP-A-2012-106386, the piezoelectric element as a drive element and an actuator substrate (actuator unit) including a bump electrode are stacked on a flow channel unit, and a substrate for supplying the power to the piezoelectric element is bonded on the actuator substrate, in a state where the piezoelectric element, the bump electrode, or the like are interposed therebetween. The substrate for supplying the power and the piezoelectric element are electrically connected through the bump electrode formed from conductive resin. Accordingly, by applying an adhesive so as to surround the periphery of the bump electrode, the actuator substrate and the substrate for supplying the power are bonded to each other. That is, the bump electrode electrically connects the piezoelectric element and the substrate for supplying the power, and also functions as a spacer for forming a space for accommodating the piezoelectric element or the like between the actuator substrate and the substrate for supplying the power. In this manner, in the structure in which the substrate is supported by only the bump electrode, there is a possibility that a substrate is damaged in a case where force (load) is applied between substrates so as to reliably connect the bump electrode and a substrate of the power supply side electrically at the time of bonding the substrates. In addition, in the configuration, since the adhesive is collected in the periphery of the bump electrode, there is a problem that joint force is also relatively weak. Therefore, a configuration in which the spacer different from the bump electrode is provided and substrates are bonded to each other by the adhesive through the spacer is also proposed.

However, recently, the miniaturization of the electronic device has been processed such that a structure related to driving of the piezoelectric element, that is, for example, a drive region, an electrode, or the like which is displaced by the driving of the piezoelectric element is formed on the substrate at a higher density. Therefore, since an adhesion region (portion which will be adhesion margins) at the time of bonding the substrates is limited, when the adhesive flows out and is widely spread on the substrate, it disrupts an obstacle in the miniaturization of the electronic device.

SUMMARY

An advantage of some aspects of the invention is to provide an electronic device, a liquid ejecting head, and a manufacturing method of the electronic device capable of contributing to miniaturization by suppressing wetting and spreading of the adhesive.

Aspect 1

An electronic device of the invention proposed to solve the object includes a first substrate including a structure body protruded from one surface; and a second substrate is stacked and disposed facing the one surface through a spacer, in which the first substrate and the spacer are bonded to each other by an adhesive, and in which the adhesive is extended up to the structure body along the one surface.

According to the configuration of Aspect 1, since wetting and spreading at the time of applying of the adhesive is regulated by the structure body, it is possible to bond the second substrate through the spacer even in a limited space on the first substrate. With this, it is possible to contribute to miniaturization and densification of the electronic device.

Aspect 2

In addition, in the configuration of Aspect 1, it is preferable that a static contact angle of the adhesive with respect to the structure body is equal to or less than 90°, and the static contact angle of the adhesive with respect to the first substrate is smaller than the static contact angle of the adhesive with respect to the structure body.

According to the configuration of Aspect 2, since the adhesive is detained in the structure body to the extent that the wetting and spreading of the adhesive on to the first substrate from the structure body are not suppressed more than necessary, it is possible to effectively suppress the wetting and spreading of the adhesive.

Aspect 3

In addition, in the configuration of Aspect 1 or Aspect 2, it is preferable that the adhesive is non-conductive.

According to the configuration of Aspect 3, even in a configuration in which a plurality of wirings are provided in the adhesion region of the first substrate and the spacer, it is possible to prevent short circuits between wirings.

Aspect 4

In addition, in the configuration of any one of Aspect 1 to Aspect 3, it is preferable that the first substrate includes a drive region on the one surface, and the structure body and the spacer are formed at a position outside the drive region.

According to the configuration, by providing the structure body and the spacer at a position outside the drive region, since the influence of vibration or the like caused by the driving of the drive region is reduced, it is possible to prevent bonding failure due to the influence.

Aspect 5

In addition, in the configuration of any one of Aspect 1 to Aspect 4, it is preferable that the spacer is provided between the drive region and the structure body.

According to the configuration of the aspect 5, even in a case where outgassing is generated from the adhesive, since the entrance of gas to the drive region side is blocked by the spacer, it is possible to suppress the generation of adverse effects on the characteristics of the drive region caused by the outgassing from the adhesive.

Aspect 6

In addition, a liquid ejecting head of the invention includes the electronic device according to any one of Aspect 1 to Aspect 5, in which a piezoelectric element for generating pressure variation to liquid within a pressure chamber formed on the first substrate by driving the drive region is provided, in which the structure body includes a curved surface curved on the second substrate side, and in which a metal layer related to driving of the piezoelectric element is formed on the curved surface.

According to the configuration of Aspect 6, by providing an electronic device with any one of the above-described configurations, it is possible to implement the miniaturization of the liquid ejecting head. In addition, since a member on which a structure body which will be an applying target of the adhesive and a metal layer related to driving of the piezoelectric element are formed is used, it is not necessary to provide a separated structure body for regulating the wetting and spreading of the adhesive. With this, it is possible to further implement the miniaturization of the electronic device and a liquid ejecting head including the electronic device.

Aspect 7

Accordingly, a manufacturing method of the electronic device of the invention is a manufacturing method of an electronic device which includes a first substrate including a structure body protruded from one surface; and a second substrate is stacked and disposed facing a surface on which the structure body of the first substrate is provided through a spacer, the method including: applying an adhesive on the structure body in the first substrate; and bonding the first substrate and the spacer in a state where the adhesive reaches from the structure body to an adhesion region of the first substrate and the spacer.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the present invention will be described with reference to the accompanying drawings. In an embodiment described below, there are various limitations as a preferred embodiment of the invention. However, the scope of the invention is not limited to these embodiments, unless there are descriptions specifically limiting the invention in the following description. In addition, in the following description, an ink jet printer (hereinafter, printer), which is a type of a liquid ejecting device, on which an ink jet recording head (hereinafter, recording head) that is a type of the liquid ejecting head included in an electronic device according to the invention is mounted will be mentioned as an example.

Figure 1:
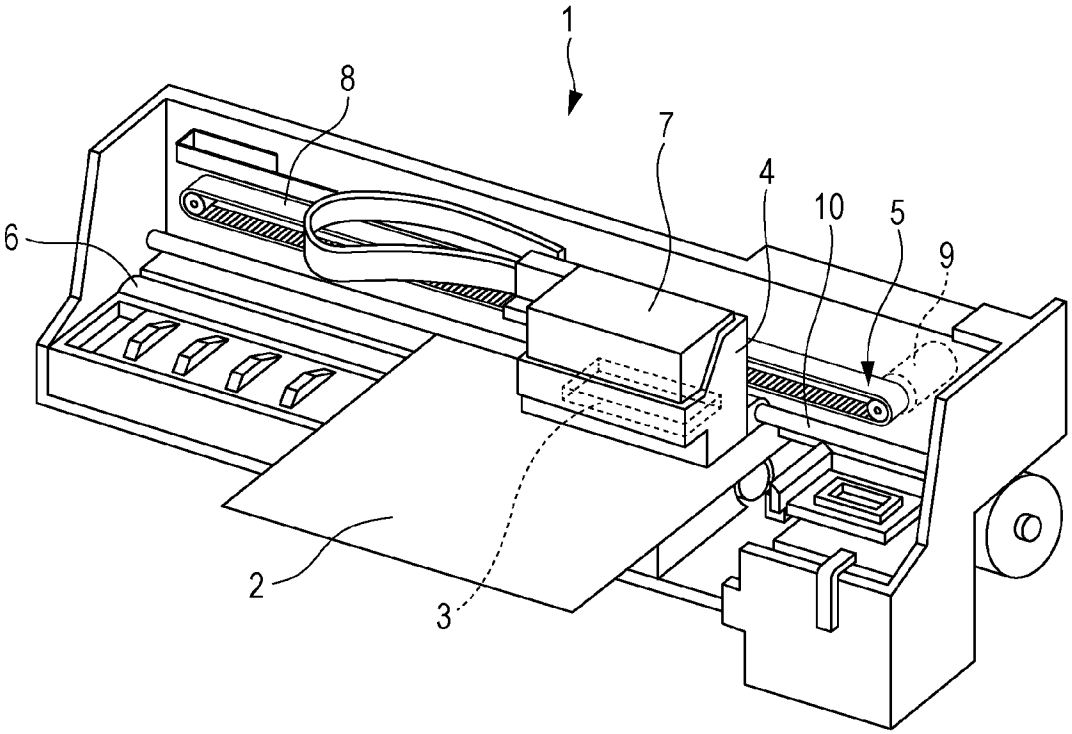
FIG. 1 is a perspective view for explaining a configuration of a printer.

A configuration of a printer 1 will be described with reference to FIG. 1. The printer 1 is a device for performing recording of an image or the like by discharging and ejecting ink (a type of solution) with respect to a surface of a recording medium 2 such as a recording paper and the like. The printer 1 includes a recording head 3, a carriage 4 to which the recording head 3 is attached, a carriage moving mechanism 5 for moving the carriage 4 in the main scanning direction, a transport mechanism 6 for moving the recording medium 2 in a sub-scanning direction, or the like. Here, the ink is stored in an ink cartridge 7 as a liquid source. The ink cartridge 7 is detachably mounted with respect to the recording head 3. It is possible to adopt a configuration in which the ink cartridge is disposed in a main body side of the printer, and the ink is supplied from the ink cartridge to the recording head via an ink supply tube.

The carriage moving mechanism 5 includes a timing belt 8. Accordingly, the timing belt 8 is driven by a pulse belt 9 such as a DC motor and the like. Therefore, when driving the pulse belt 9, the carriage 4 is reciprocated in the main scanning direction (width direction of recording medium 2), by being guided by a guide rod 10 installed in the printer 1. The position of the main scanning direction of the carriage 4 is detected by a linear encoder not illustrated. The linear encoder transmits the detection signal, that is, an encoder pulse to a control unit of the printer 1.

Figure 2:
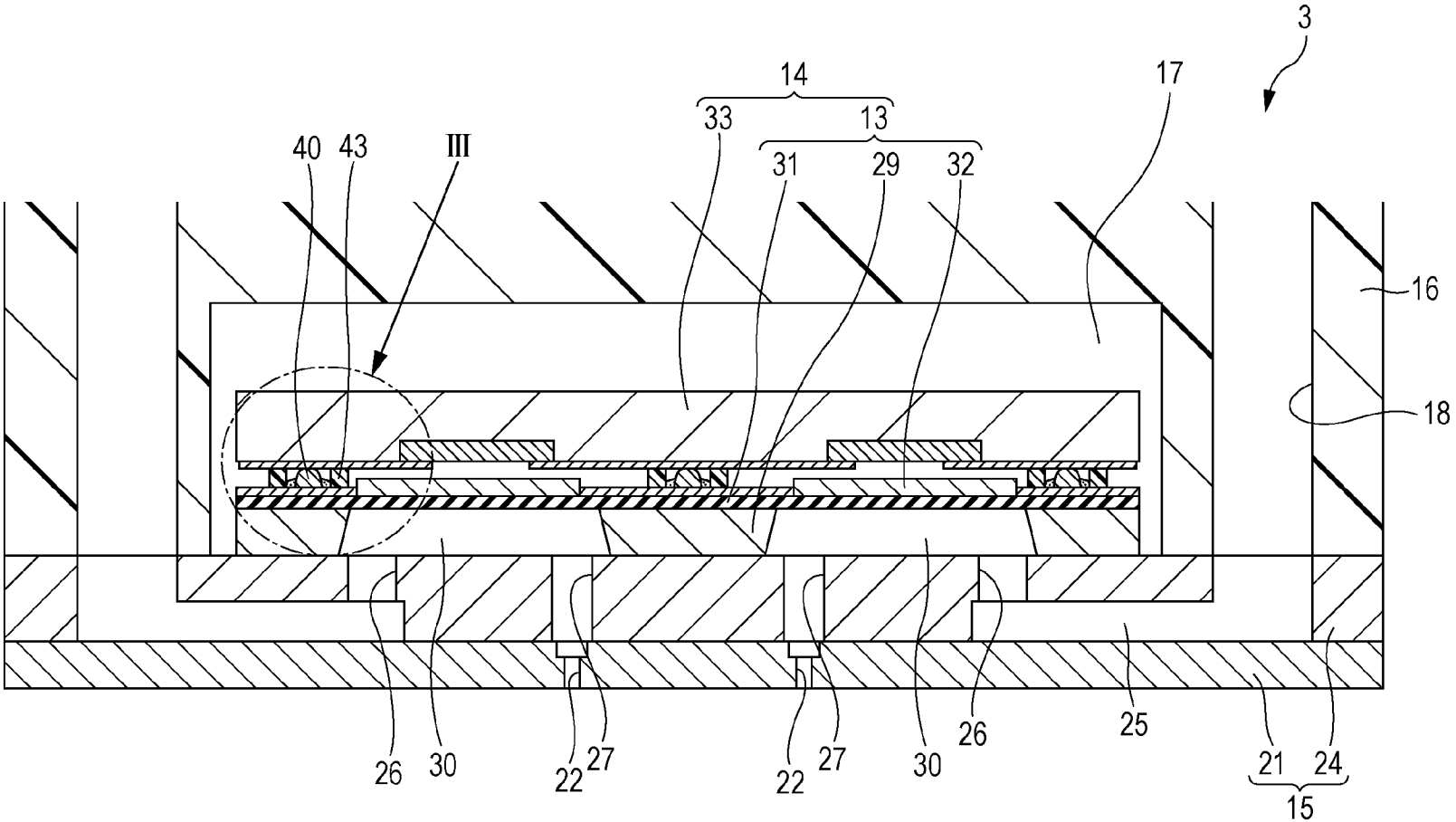
FIG. 2 is a sectional view for explaining a configuration of a recording head.
Figure 3:
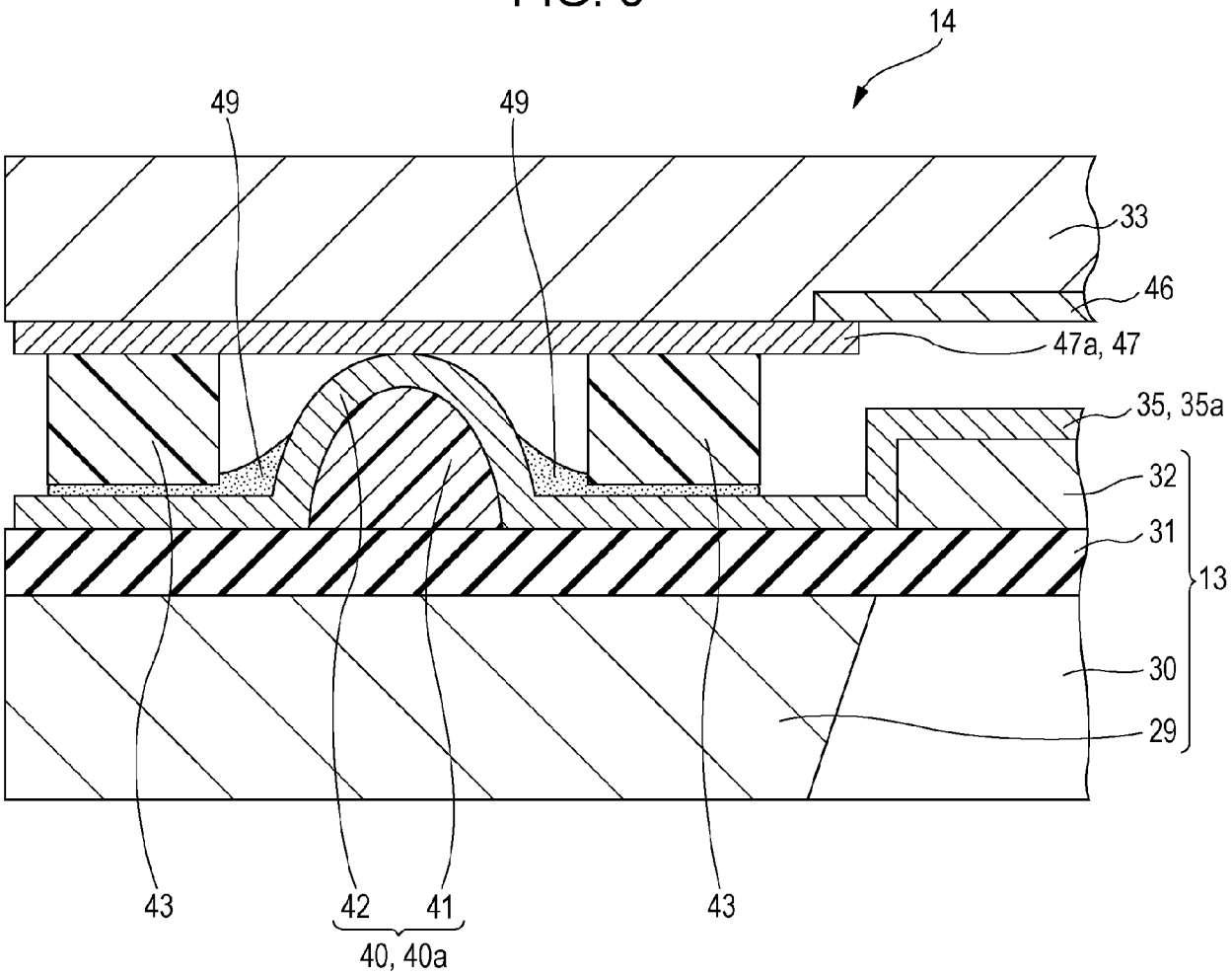
FIG. 3 is an enlarged sectional view of a main part of an electronic device.
Figure 4:
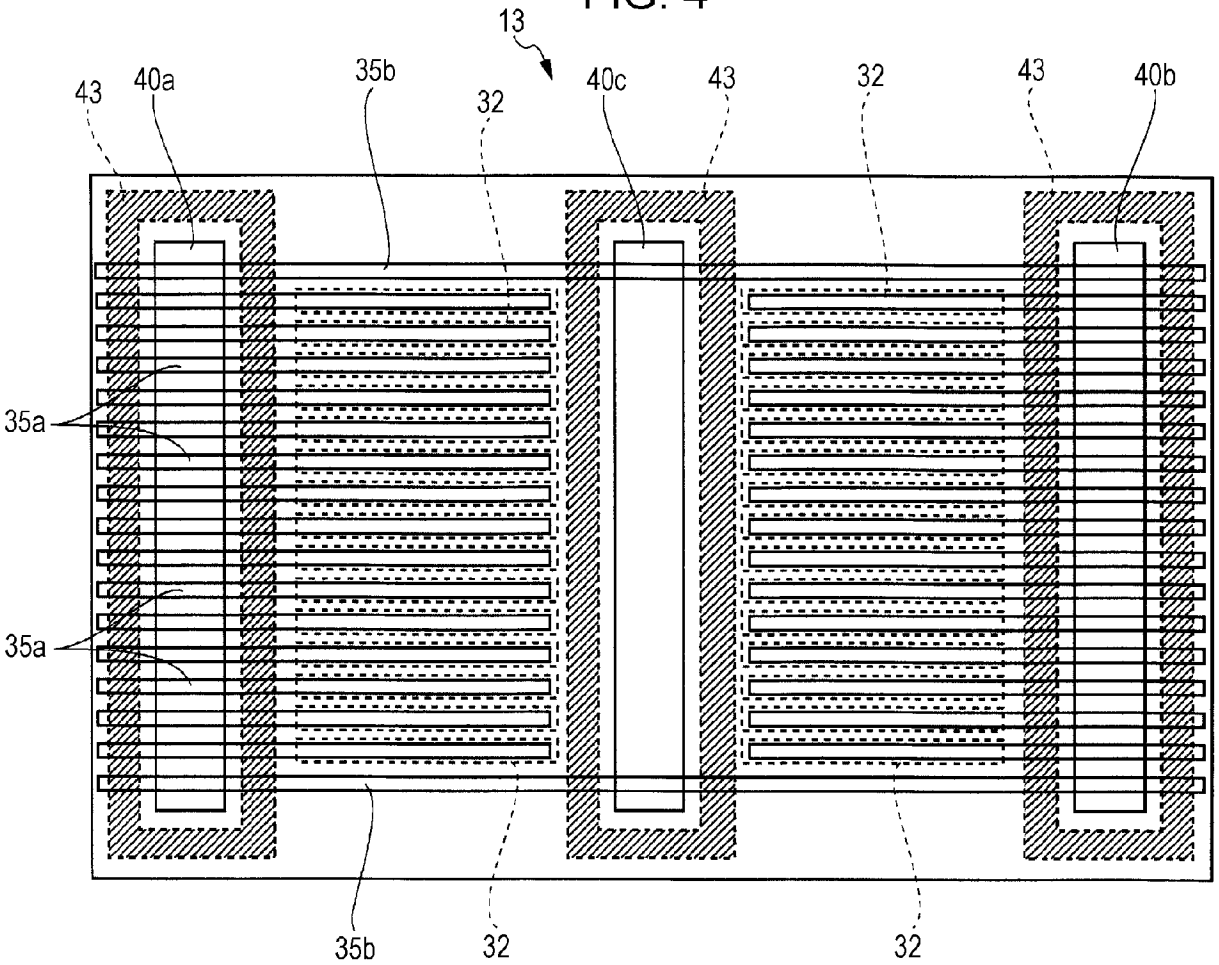
FIG. 4 is a plan view of an actuator substrate.

Next, the recording head 3 will be described. FIG. 2 is a sectional view for explaining a configuration of the recording head 3. FIG. 3 is an enlarged view of the region III in FIG. 2, and a sectional view in which a main part of the electronic device 14 is built into the recording head 3. In addition, FIG. 4 is a plan view (top view) of the actuator substrate 13. As described in FIG. 2, the recording head 3 in the embodiment is attached to a head case 16 in a state where the electronic device 14 and the flow channel unit 15 are stacked. For convenience, the stacking direction of each part will be described as a vertical direction.

The head case 16 is a box shape member made of synthetic resin, and an ink introduction path 18 for supplying ink to each of the pressure chambers 30 is formed on the inside thereof by passing through the height direction of the case. The ink introduction path 18 is communicated with a common liquid chamber 25 of the flow channel unit 15, and a flow path for supplying the ink from the ink cartridge 7 side to the common liquid chamber 25. In addition, on a lower surface side of the head case 16, an accommodating space 17 of a recessed rectangular shape is formed from the lower surface side up to the middle of the height direction of the head case 16. When the flow channel unit 15 described below is bonded in a state where the flow channel unit 15 being positioned on a lower surface of the head case 16, the electronic device 14 stacked on a communication substrate 24 is configured to be accommodated within the accommodating space 17.

The flow channel unit 15 bonded on the lower surface of the head case 16 includes the communication substrate 24 and a nozzle plate 21. The communication substrate 24 in the embodiment is made from a silicon single crystal substrate. As described in FIG. 2, in the communication substrate 24, a reservoir (common liquid chamber) 25 for communicating with the ink introduction path 18 and storing common ink in each of the pressure chambers 30, and an individual communication path 26 for individually supplying ink from the ink introduction path 18 to each of the pressure chambers 30 through the reservoir 25 are formed by etching. The reservoir 25 is a long hollow portion along the nozzle array direction (juxtaposed direction of pressure chamber 30). A plurality of the individual communication paths 26 are formed along the juxtaposed direction of the pressure chamber 30 corresponding to each of the pressure chambers 30. The individual communication path 26 is communicated with an end portion of a corresponding pressure chamber 30 in the longitudinal direction, in a state where the communication substrate 24 and a pressure chamber formation substrate 29 are bonded.

In addition, a nozzle communication path 27 that passes through the thickness direction of the communication substrate 24 is formed at a position corresponding to each of nozzles 22 of the communication substrate 24. That is, a plurality of the nozzle communication paths 27 are formed along the nozzle array direction corresponding to the nozzle array. The pressure chamber 30 and the nozzle 22 are communicated through the nozzle communication path 27. In the embodiment, the nozzle communication path 27 is communicated with an end portion of the other side (opposite side to individual communication path 26) in the longitudinal direction of a corresponding pressure chamber 30, in a state where the communication substrate 24 and the pressure chamber formation substrate 29 are bonded.

The nozzle plate 21 is a substrate made of silicon or metal such as stainless steel and the like bonded to a lower surface (opposite surface side to pressure chamber formation substrate 29) of the communication substrate 24. A plurality of the nozzles 22 are established in a row in the nozzle plate 21 in the embodiment. The plurality of the nozzles 22 that are installed configure a nozzle row provided along the sub-scanning direction perpendicular to the main scanning direction, in a pitch corresponding to dot formation density.

The electronic device 14 in the embodiment includes an actuator substrate 13 on which a thin plate shape configuration member, which functions as an actuator for generating pressure fluctuation in the ink within each of the pressure chambers 30, is stacked. More specifically, as described in FIG. 2, the actuator substrate 13 is configured by stacking the pressure chamber formation substrate 29, a vibration plate 31, a piezoelectric element 32 (type of drive element and actuator), or the like. Furthermore, by bonding a sealing plate 33, which secures the piezoelectric element 32 and supplies a drive signal to the piezoelectric element 32, on one surface (surface of side on which piezoelectric element 32 and bump electrode 40 described below are formed) of the actuator substrate 13, the electronic device 14 is configured. The spacers 43 are interposed between the actuator substrate 13 and the sealing plate 33, and the sealing plate 33 is stacked on one surface of the actuator substrate 13 in a state where a gap is formed by the spacer 43. The spacers 43 are formed on a lower surface (bonding surface with actuator substrate 13) of the sealing plate 33, and a distal end surface of the spacers 43 and the actuator substrate 13 are bonded through the adhesive 49. The spacers 43 will be described below.

The pressure chamber formation substrate 29 in the embodiment is manufactured from the silicon single crystal substrate. A space which will be the pressure chamber 30 is formed by etching in the pressure chamber formation substrate 29. The space partitions the pressure chamber 30 by blocking the upper and lower surfaces by the vibration plate 31 and the communication substrate 24. Hereinafter, the pressure chamber including the space is referred to as the pressure chamber 30. A plurality of the pressure chambers 30 are juxtaposed on the pressure chamber formation substrate 29 corresponding to each of the nozzles 22. Each of the pressure chambers 30 is a long hollow portion in a direction perpendicular to the nozzle array direction, the individual communication path 26 of the communication substrate 24 is communicated with an end portion of one side in the longitudinal direction, and the nozzle communication path 27 of the communication substrate 24 is similarly communicated with an end portion of the other side. The ink introduced to the reservoir 25 of the communication substrate 24 is supplied to the pressure chamber 30 through each of the individual communication paths 26.

The vibration plate 31 is a thin film member having elasticity, and formed on an upper surface (opposite surface side to communication substrate 24 side) of the pressure chamber formation substrate 29. An upper opening of the pressure chamber 30 is sealed by the vibration plate 31. A portion corresponding to the upper opening of the pressure chamber 30 in the vibration plate 31 functions as a flexible surface displaced in a direction away from or a direction close to the nozzle 22 according to bending deformation of an active portion (to be described below) of the piezoelectric element 32. That is, a region corresponding to the upper opening of the pressure chamber 30 in the vibration plate 31 becomes a drive region capable of allowing deformation by driving the piezoelectric element 32. Meanwhile, in the vibration plate 31, a region outside the upper opening of the pressure chamber 30 becomes a non-drive region in which bending deformation is restricted.

For example, the vibration plate 31 is formed from an elastic film made of silicon dioxide ($SiO_2$) formed on the upper surface of the pressure chamber formation substrate 29 and an insulating film made of zirconia (zirconium oxide, $ZrO_2$) formed on the elastic film. Accordingly, each of the active portion of the piezoelectric element 32 is stacked on the drive region corresponding to the upper opening of each of the pressure chambers 30 on the insulating film. It is possible to adopt a configuration in which the pressure chamber formation substrate and the drive region (flexible surface) are integrally provided. That is, it is also possible to adopt a configuration where etching processing is performed from a lower surface side of the pressure chamber formation substrate, a pressure chamber hollow portion is formed by leaving a thin walled portion of a sheet thickness on the upper surface side, and the thin walled portion functions as the drive region.

The piezoelectric element 32 of the embodiment is the piezoelectric element of a so-called deflection vibration mode. For example, the piezoelectric element 32 is formed by sequentially laminating a lower electrode layer, a piezoelectric layer, and an upper electrode layer not illustrated on the vibration plate 31. One electrode layer of the upper and lower electrodes functions as an individual electrode for each of the piezoelectric elements 32, and the other electrode layer functions as a common electrode for the piezoelectric elements 32. The piezoelectric element 32 configured as described above deforms the deflection in a direction away from or a direction close to the nozzle 22, when an electric field according to a potential difference of both electrodes between the lower electrode layer and the upper electrode layer is applied. A portion in which the deflection is deformed functions as the active portion of the piezoelectric element 32. A plurality of the piezoelectric elements 32 are juxtaposed along the nozzle array direction corresponding to each of the nozzles 22, and as described in FIG. 4, two piezoelectric element groups corresponding to two pairs of nozzle arrays are formed on the actuator substrate 13 by pinching the bump electrode 40 formed on the center portion of the substrate therebetween.

As described in FIG. 3, an individual lead electrode 35*a* conducted with the individual electrode of the piezoelectric element 32 and a common lead electrode 35*b* conducted with the common electrode are extended respectively up to the vibration plate 31 corresponding to the non-drive region by exceeding an upper opening edge of the pressure chamber 30. In the middle of each of the lead electrodes 35 in the non-drive region, each of the bump electrodes 40 is protruded toward the sealing plate 33 side. The bump electrode 40 is a contact point for connecting a drive circuit 46 of the sealing plate 33 described below and the lead electrodes 35 (35*a* and 35*b*) of the piezoelectric element 32, and a type of a structure body protruded from one surface of the actuator substrate 13. The bump electrode 40 in the embodiment is configured with an internal resin (resin core) 41 as a ridge extending along the juxtaposed direction (nozzle array direction) of the pressure chamber and a conductive film 42 conducted to the piezoelectric element 32 by extending in the pressure chamber longitudinal direction along the surface of the internal resin 41. For example, the internal resin 41 is formed by the resin having elasticity such as polyimide resin, and formed in the non-drive region on the vibration plate 31. The internal resin 41 has a curved surface which is curved toward the sealing plate 33 in the sectional view. In addition, the conductive film 42 is a part of the lead electrode 35, has the same width as the lead electrode 35, and has an arch shape in the sectional view along the surface shape of the internal resin 41. A plurality of the conductive films 42 are formed along the nozzle array direction at regular intervals from each other in the non-drive region corresponding to each of the lead electrodes 35. That is, the bump electrode 40 is provided at a position outside the drive region. Similarly, the spacer 43 is also provided in the non-drive region outside the drive region. With this, since the influence of vibration caused by the driving of the drive region is reduced, it is possible to prevent defective bonding or the like in the bump electrode 40 and the spacer 43 due to the influence.

As described in FIG. 4, in the actuator substrate 13 of the embodiment, a total of three bump electrodes 40 of the bump electrodes 40*a* and 40*b* respectively formed on the non-drive region of both end portions (outer peripheral side) in the pressure chamber longitudinal direction and the bump electrode 40*c* formed on the non-drive region between piezoelectric element groups, are provided. In the embodiment, the bump electrodes 40*a* and 40*b* of both the end portions are the bump electrodes for the individual lead electrode 35*a*, and the bump electrode 40*c* is the bump electrode for the common lead electrode 35*b*.

The sealing plate 33 (corresponding to second substrate in the invention) is plate material made of a silicon substrate of the same size as the pressure chamber formation substrate 29. In the embodiment, the drive circuit 46 according to the driving of the piezoelectric element 32 is formed in a region facing the piezoelectric element 32 of the sealing plate 33. The drive circuit 46 is formed by using a semiconductor process on a surface of the silicon single crystal substrate which will be the sealing plate 33. In addition, a wiring layer 47 connected to the drive circuit 46 is formed on a lower surface of the sealing plate 33, that is, on the drive circuit 46 of a surface of the piezoelectric element 32 side at the time of bonding with the pressure chamber formation substrate 29, in a state where the wiring layer 47 is exposed on a surface of the vibration plate 31 side in the sealing plate 33, that is, on a bonding surface with the vibration plate 31. The wiring layer 47 is formed on a further outer side than the drive circuit 46, and formed up to a position corresponding to the bump electrode 40 in the non-drive region of the actuator substrate 13. Specifically, the wiring layer 47 corresponding to the bump electrode 40 of the individual lead electrode 35*a* of the piezoelectric element 32, and the wiring layer 47 corresponding to the bump electrode 40 of the common lead electrode 35*b* of each of the piezoelectric elements 32 are formed on a surface (surface of pressure chamber formation substrate 29 side) of the sealing plate 33 by patterning. Each of the wiring layers 47 is electrically connected with a corresponding wiring terminal within the drive circuit 46.

As described in FIG. 3, the pressure chamber formation substrate 29 on which the vibration plate 31 and the piezoelectric element 32 are stacked, and the sealing plate 33 are bonded by the adhesive 49 between the spacer 43 and the actuator substrate 13, in a state where the spacer 43 provided in the bump electrode 40, the piezoelectric element 32, and the sealing plate 33 are interposed therebetween. The spacer 43 in the embodiment is produced from the photosensitive resin which is cured by irradiation of light, and formed on the bonding surface with the actuator substrate 13 in the sealing plate 33. For example, as material of the spacer 43, thermosetting resins including photopolymerization initiator or the like are preferably used as the main component of epoxy resins, acrylic resins, phenol resins, polyimide resins, silicone resins, styrene resins, or the like. Specifically, from the viewpoint of chemical resistance, it is more preferable that the epoxy resin is used as the main component.

The spacer 43 is patterned on the substrate through the photolithography process, that is, coating on the substrate, pre-baked (pre-curing), exposure, developing, post-baking (main curing), or the like. As described in FIG. 3 and FIG. 4, the spacer 43 in the embodiment is formed in a long rectangular annular shape in the nozzle array direction so as to surround the periphery of the bump electrode 40. By the spacer 43, a gap is formed between the actuator substrate 13 and the sealing plate 33 as described above. The height (dimension of direction perpendicular to substrate) of the spacer 43 is set equal to or slightly lower than the height (protrusion length from lead electrode 35) of the bump electrode 40. The gap formed between the sealing plate 33 and the actuator substrate 13 by the spacer 43 and the bump electrode 40 is set to a height of an extent that does not inhibit deformation of the piezoelectric element 32. In addition, in a state where the sealing plate 33 and the actuator substrate 13 are bonded, a space in which the bump electrode 40 is formed and a space in which the active portion of the piezoelectric element 32 is formed are separated by the spacer 43.

Figure 5:
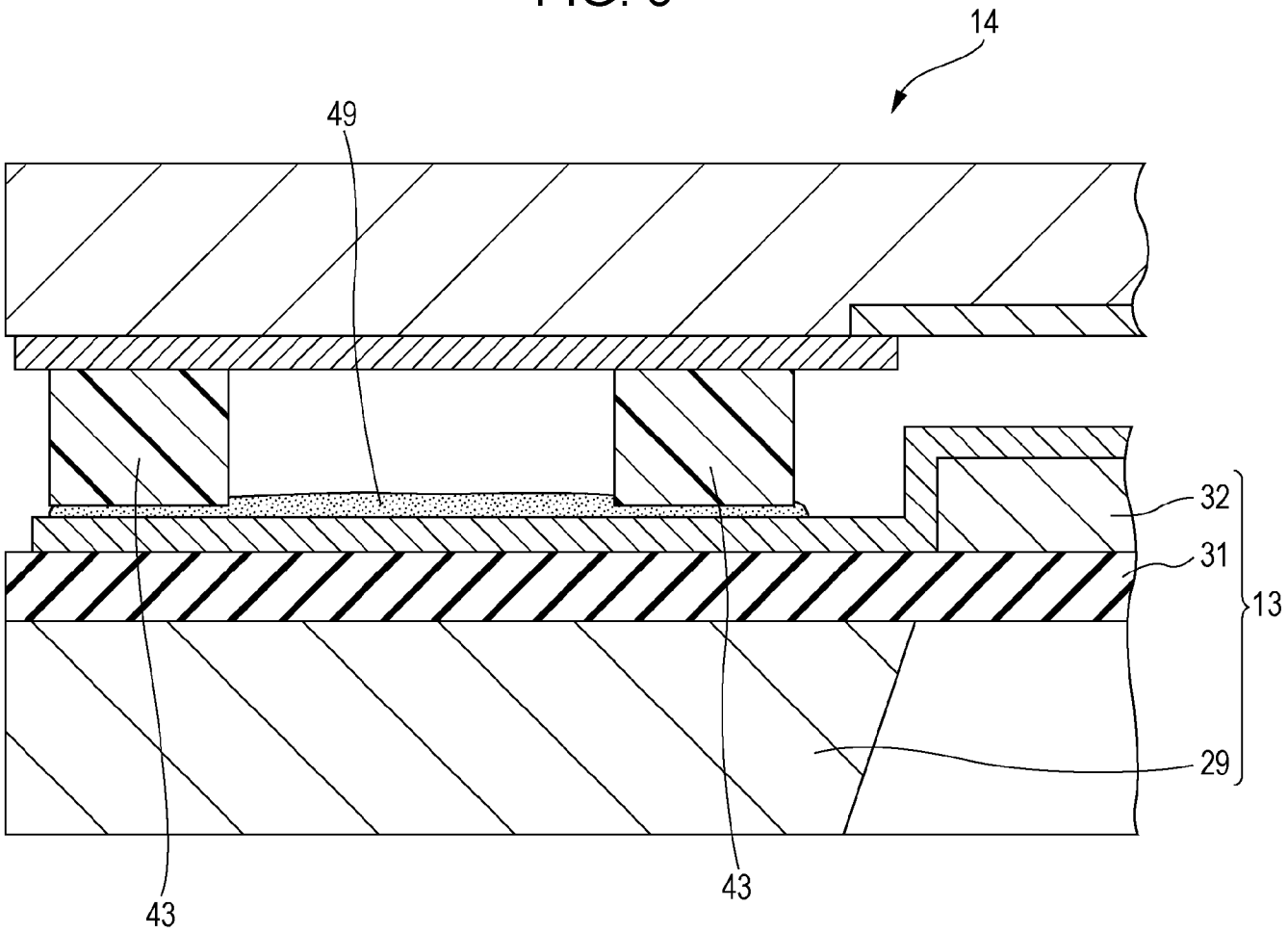
FIG. 5 is an enlarged sectional view of a main part of an electronic device of a comparison example.

As the adhesive 49, a non-conductive epoxy adhesive is used. With this, as the embodiment, even in a configuration where a plurality of wirings, that is, a plurality of the lead electrodes 35 are provided in the adhesion region (portion where actuator substrate 13 and spacer 43 are overlapped in direction perpendicular to substrate) of the actuator substrate 13 and the spacer 43, it is possible to prevent short circuits between different wirings. The adhesive 49 is to bond the spacer 43 of the sealing plate 33 side and the actuator substrate 13. However, as described in FIG. 3, the adhesive 49 is extended from the adhesion region up to the bump electrode 40 along one surface of the actuator substrate 13, in addition to the adhesion region between the bonding surface (opposite surface side to sealing plate 33 side) of these spacers 43 and the actuator substrate 13. In other words, the adhesive 49 coated on the bump electrode 40 is wet and spread on one surface of the actuator substrate 13 such that the adhesive 49 is continuous from the bump electrode 40 up to the adhesion region. A static contact angle with respect to the actuator substrate 13 of the adhesive 49 is smaller than a static contact angle with respect to the bump electrode 40 of the adhesive 49. However, a static contact angle with respect to the bump electrode 40 of the adhesive 49 is equal to or less than 90°. Therefore, since the adhesive 49 is detained in the bump electrode 40 to the extent in which the wetting and spreading of the adhesive 49 from the bump electrode 40 on the actuator substrate 13 are not interfaced more than necessary, the wetting and spreading are suppressed on the actuator substrate 13, compared to a case where the adhesive 49 is directly coated on the actuator substrate 13, as illustrated in FIG. 5. Therefore, it is also possible to bond the sealing plate 33 on a limited space on the actuator substrate 13. In the embodiment, specifically, it is possible to bond the adhesive 49 and the spacer 43 with the sealing plate 33 without interfering with the drive region. With this, it is possible to contribute to miniaturization and densification of the electronic device 14. Accordingly, a coating amount of the wet and spread adhesive 49 and the distance between the adhesion region and the bump electrode 40 are set such that the set and spread adhesive 49 does not exceed the adhesion region between the bonding surface (opposite surface side to sealing plate 33 side) of the spacer 43 and the actuator substrate 13. With this, the adhesive 49 is not exposed in the drive region side of an opposite side to the bump electrode side as a boundary of the spacer 43. In addition, since the spacer 43 is provided between the drive region and the bump electrode 40 in one surface of the actuator substrate 13, even in a case where outgassing is generated from the adhesive 49, the entrance of gas to the drive region side is blocked by the spacer 43 which will be a barrier. Therefore, the generation of adverse effects in characteristics of the piezoelectric element 32 caused by the outgassing from the adhesive 49 is suppressed.

Hereinafter, a manufacturing process of the electronic device 14, specifically, a bonding process of the actuator substrate 13 as the first substrate including the drive region, and the spacer 43 of the sealing plate 33 as the second substrate will be described. In the embodiment, after bonding the silicon single crystal substrate on which a plurality of regions which will be the sealing plate 33 are formed, and the silicon single crystal substrate on which a plurality of regions which will be the actuator substrate 13 are formed by stacking the vibration plate 31 and the piezoelectric element 32, and then the electronic device 14 is obtained by cutting and dicing the bonding result.

FIGS. 6A to 6C and FIGS. 7A to 7C are pattern diagrams for explaining a manufacturing process of the electronic device 14, and illustrate a configuration in the vicinity of the bump electrode 40 and the spacer 43. First, the vibration plate 31 is formed on a surface of the pressure chamber formation substrate 29. Furthermore, the internal resin 41 of the bump electrode 40 is formed on the non-drive region of the vibration plate 31. Specifically, after resin that is material is coated in a predetermined thickness, the internal resin 41 that exhibits a protrusion at a predetermined position is patterned through the pre-baking process, the photolithography process, the etching process, the post-baking process, or the like. If the internal resin 41 is formed, the lower electrode layer, the piezoelectric layer, the upper electrode layer, the lead electrode 35, the conductive film 42, and the like are sequentially laminated and patterned, and then the piezoelectric element 32 is formed. In the embodiment, the lead electrode 35 on the vibration plate 31 is formed on the non-drive region of the vibration plate 31. In addition, the conductive film 42 is formed along a surface of the internal resin 41 on the internal resin 41. With this, as described in FIG. 6A, the bump electrode 40 conducted to the piezoelectric element 32 is formed on the non-drive region of the vibration plate 31.

Meanwhile, in the sealing plate 33 side, first, the drive circuit 46 is formed on a bonded surface with the pressure chamber formation substrate 29 (vibration plate 31) by a semiconductor process. If the drive circuit 46 is formed, after a metal film which will be the wiring layer 47 is formed on the bonding surface of the sealing plate 33, the wiring layer 47 is patterned by the photolithography process and the etching process. Next, as described in FIG. 6B, the spacers 43 are formed on a bonding surface of the sealing plate 33. Specifically, through the pre-baking by coating and heating of the photosensitive resin material that is material of the spacer 43, patterning by exposure and development, and the post-baking, the spacer 43 of an annular shape surrounding the bump electrode 40 of the actuator substrate 13 side is patterned.

Figure 6A:
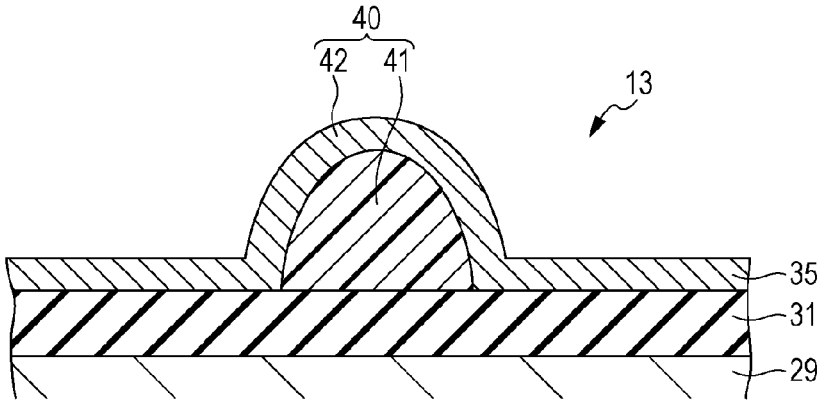
FIGS. 6A to 6C are process charts for explaining a manufacturing process of the electronic device.
Figure 6B:
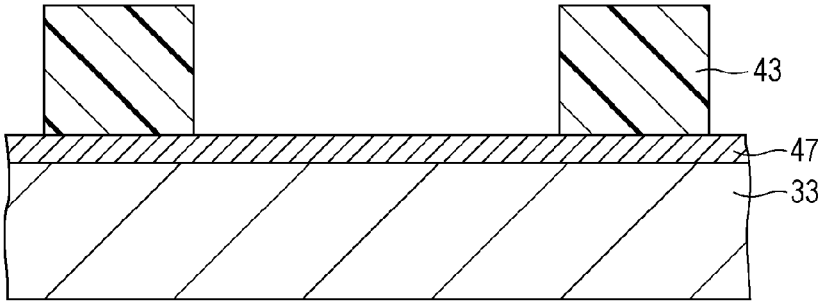
Figure 6C:
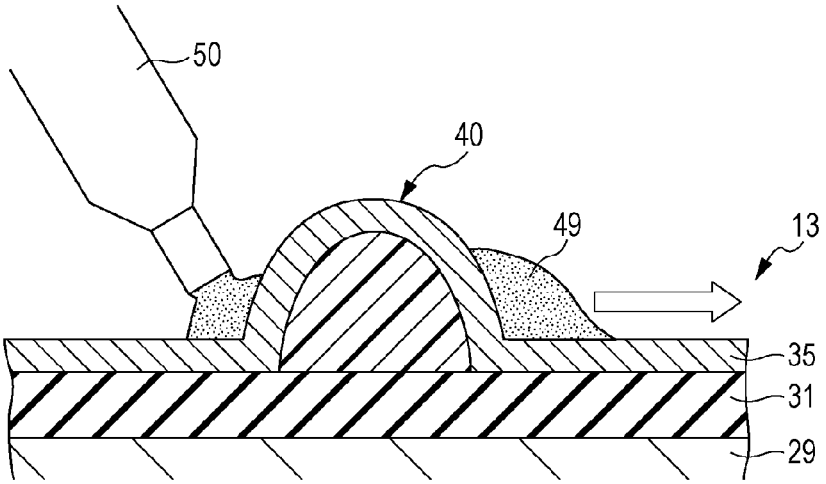
Figure 7A:
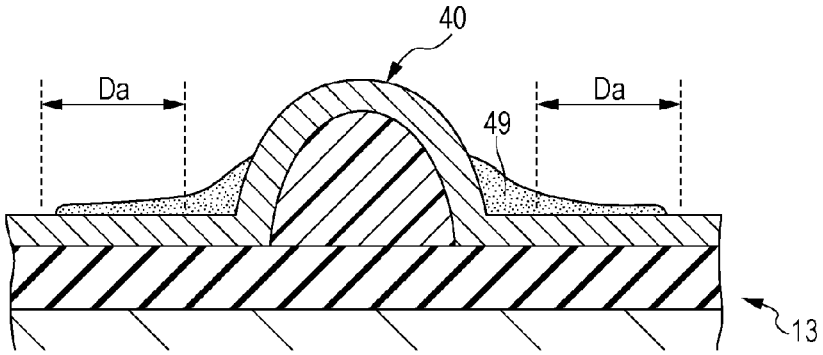
FIGS. 7A to 7C are process charts for explaining a manufacturing process of the electronic device.
Figure 7B:
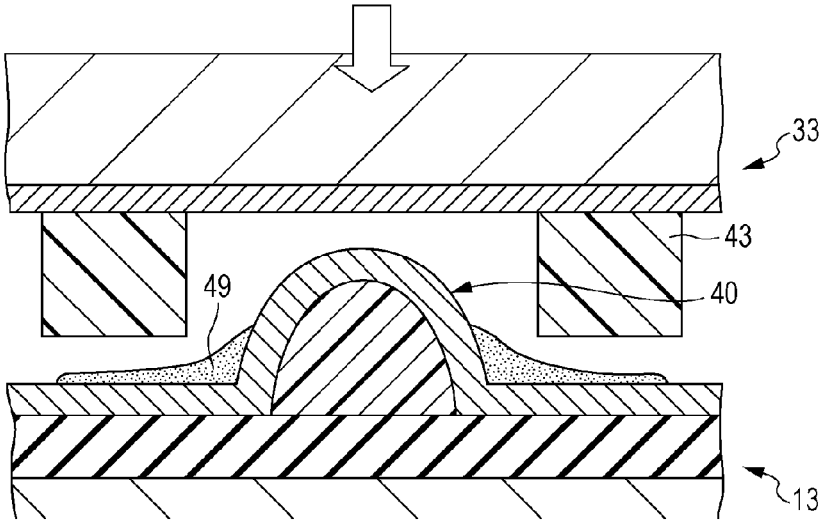
Figure 7C:
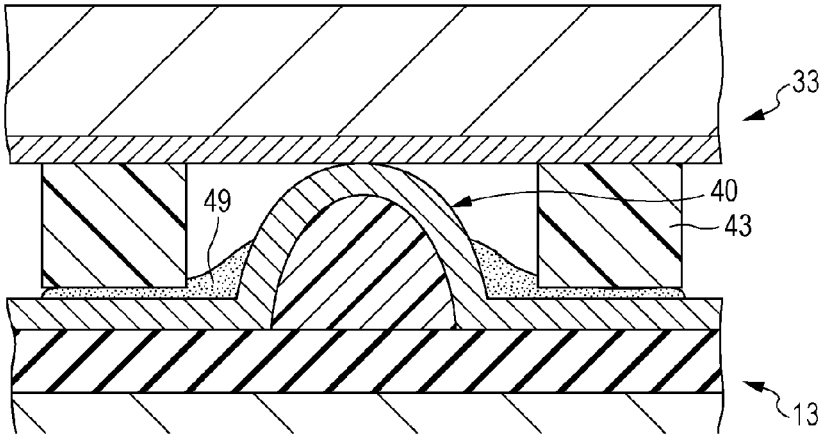

Next, as described in FIG. 6C, the adhesive 49 is coated by a dispenser 50 in the periphery of the bump electrode 40 of the actuator substrate 13 (coating process). Since the bump electrode 40 as a structure body in the embodiment is a long convex portion along the nozzle array, the adhesive 49 is coated along the extending direction of the bump electrode 40 on an upper surface (bonding surface with sealing plate 33) of the actuator substrate 13 and the corner portions of both sides formed in the side surfaces of the bump electrode 40. Alternatively, by coating the adhesive 49 on the top portion of the bump electrode 40, the adhesive 49 may flow along the curved surface from the top portion to the both sides of the bump electrode 40. Even in a case where the adhesive 49 is coated on the top portion of the bump electrode 40, since the adhesive 49 escapes by being pressed between the wiring layer 47 of the sealing plate 33 side and the sealing plate 33 at the time of bonding with the sealing plate 33, the conductive film 42 of the bump electrode 40 and the wiring layer 47 are conducted without problems. The adhesive 49 coated on the bump electrode 40 is wet and spread from the bump electrode 40 on one surface of the actuator substrate 13, as illustrated in FIG. 6C with an arrow. At this time, since the adhesive 49 also wets the bump electrode 40, as described in FIG. 7A, the wetting and spreading to the drive region side are suppressed by exceeding an adhesion region Da of a bonding surface of the spacer 43 and the actuator substrate 13.

If the adhesive 49 is coated on the actuator substrate 13, and then the actuator substrate 13 and the sealing plate 33 are bonded (bonding process). Specifically, as described in FIG. 7B, in a case where the relative position of both silicon single crystal substrates is aligned, both substrates are relatively moved in the direction in which both substrates are adjacent to each other, and in a state where the bump electrode 40, the piezoelectric element 32, and the like are pinched between both the substrates, the bonding surface of the spacer 43 and the actuator substrate 13 are attached to each other through the adhesive 49. The adhesive 49 is pressed and spread between the bonding surface of the spacer 43 and the actuator substrate 13. However, since the adhesive 49 is seated within the adhesion region Da, and covered and hidden by the bonding surface of the spacer 43 and the actuator substrate 13, the adhesive 49 is almost not exposed in the drive region side. Accordingly, as described in FIG. 7C, by heating the substrate in a state where force (load) in the direction pinching the spacer 43 is maintained while resisting the elastic force of the bump electrode 40 and the spacer 43, the curing of the adhesive 49 is promoted.

Through such a process, a gap is formed by the spacer 43, in a state where the bump electrode 40 of the lead electrode 35 side and the wiring layer 47 of the sealing plate 33 are electrically connected, both substrates are bonded by the adhesive 49.

If both silicon single crystal substrates are bonded, the pressure chamber 30 is formed through the lapping process, the photolithography process, and the etching process, with respect to the silicon single crystal substrate (pressure chamber formation substrate 29) of the actuator substrate 13 side. Finally, the silicon single crystal substrate is scribed along a predetermined scribe line, and cut and divided into an individual electronic device 14. In the embodiment, a configuration where two silicon single crystal substrates are bonded and diced is exemplified. However, the embodiment is not limited thereto. For example, first, the sealing plate and the pressure chamber formation substrate are respectively diced and then the diced result may be bonded.

Accordingly, the electronic device 14 manufactured by the above process is positioned and fixed in the flow channel unit 15 (communication substrate 24) by using the adhesive or the like. Accordingly, in a state where the electronic device 14 is accommodated in the accommodating space 17 of the head case 16, the recording head 3 is formed by bonding the head case 16 and the flow channel unit 15.

By the configuration as described above, the electronic device 14 can be miniaturized. That is, by decreasing an area of wetting and spreading at the time of coating the adhesive 49, it is possible to bond the spacer 43 of the sealing plate 33 and the actuator substrate 13 without interfering with the drive region or the like even in a limited space on the actuator substrate 13. With this, it is possible to contribute to miniaturization and densification of the electronic device 14. In addition, in one surface of the actuator substrate 13, since the spacer 43 is provided between the bump electrode 40 and the drive region, although the outgassing is generated from the adhesive 49, the entrance of gas to the drive region side is blocked by a barrier of the spacer 43. Therefore, it is possible to suppress adverse effects (characteristic degradation or the like) caused by the outgassing of the adhesive 49 with respect to the drive region. Furthermore, in the embodiment, according to a configuration where the sealing plate 33 and the actuator substrate 13 are supported by the spacer 43, it is unlikely to generate a failure such as a crack at the time of bonding substrates, at the time of applying a load, and the like, and the yield is improved.

In addition, in the embodiment, since the bump electrode 40 as a structure body which will be a coating target of the adhesive 49 is used, it is not necessary to provide a separated structure body for regulating the wetting and spreading of the adhesive 49. With this, it is possible to further implement the miniaturization of the electronic device 14.

Accordingly, by providing the electronic device 14, it is possible to implement the miniaturization of the recording head 3 and the printer 1.

In the embodiment, a configuration where the bump electrode 40 as the structure body which will be the coating target of the adhesive 49 is used is exemplified. However, the embodiment is not limited thereto. The configuration may be a structure body protruded from one surface of the actuator substrate 13 to the sealing plate 33 side, and may be formed along the adhesion region at a position closer to the adhesion region.

Figure 8:
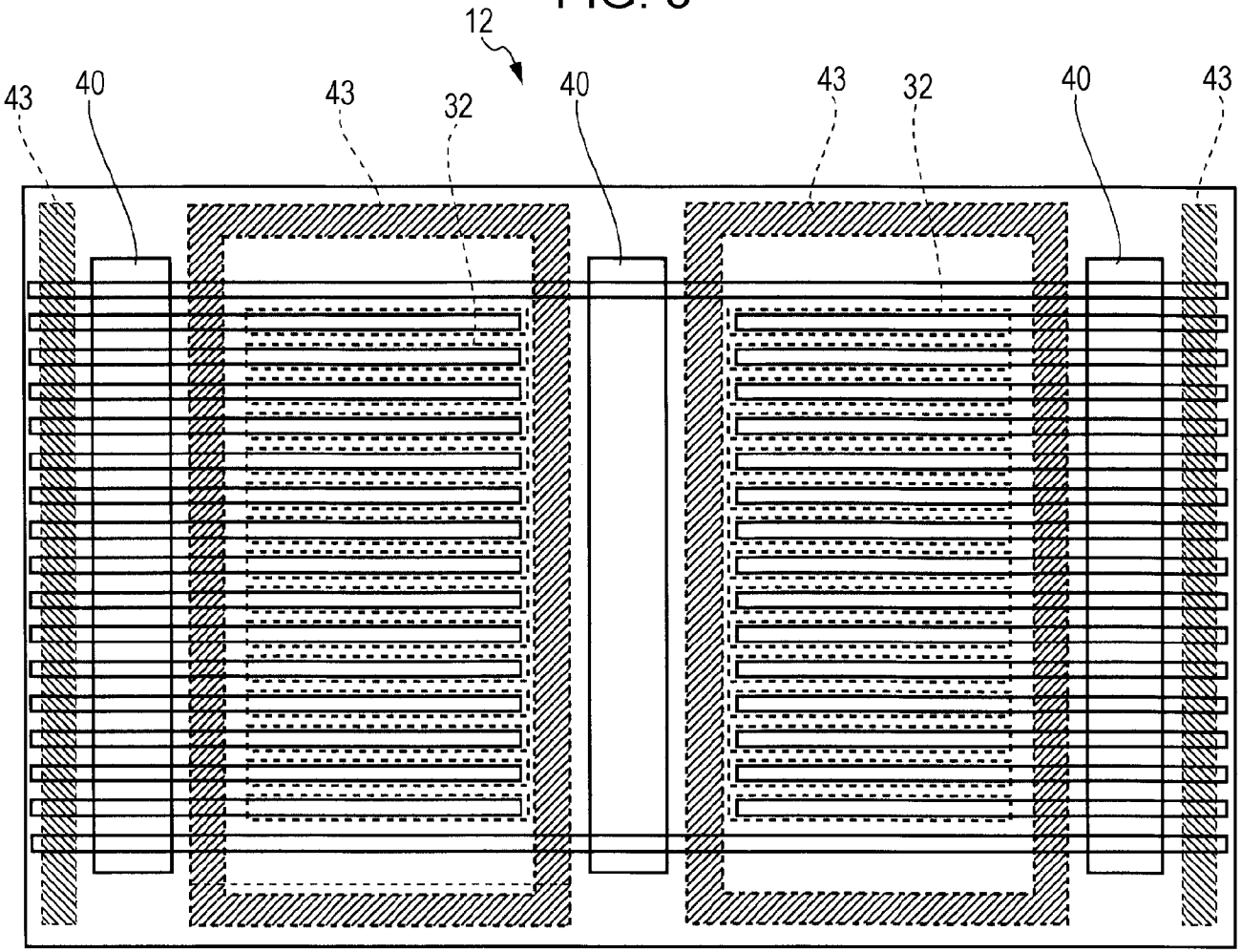
FIG. 8 is a plan view of an actuator substrate in a second embodiment.

In addition, in the embodiment, a configuration where the spacer 43 is disposed so as to surround the periphery of the bump electrode 40 that is the structure body which will be the coating target of the adhesive 49 is used is exemplified. However, the embodiment is not limited thereto. For example, in the second embodiment illustrated in FIG. 8, the spacer 43 of a frame shape surrounding the drive region in which the active portion of the piezoelectric element 32 is juxtaposed is disposed. In addition, the spacer 43 of a wall shape is formed along the nozzle array direction on the outer peripheral side of the actuator substrate 13 by pinching the bump electrode 40 more than the spacer 43 of the frame shape. As described above, since a space for accommodating the drive region is partitioned and sealed by the spacer 43 of the frame shape surrounding the drive region between the sealing plate 33 and the actuator substrate 13, it is possible to reliably protect the drive region from influence of the outgassing of the adhesive 49, outside air, or the like. Another configuration is the same as the first embodiment.

Figure 9:
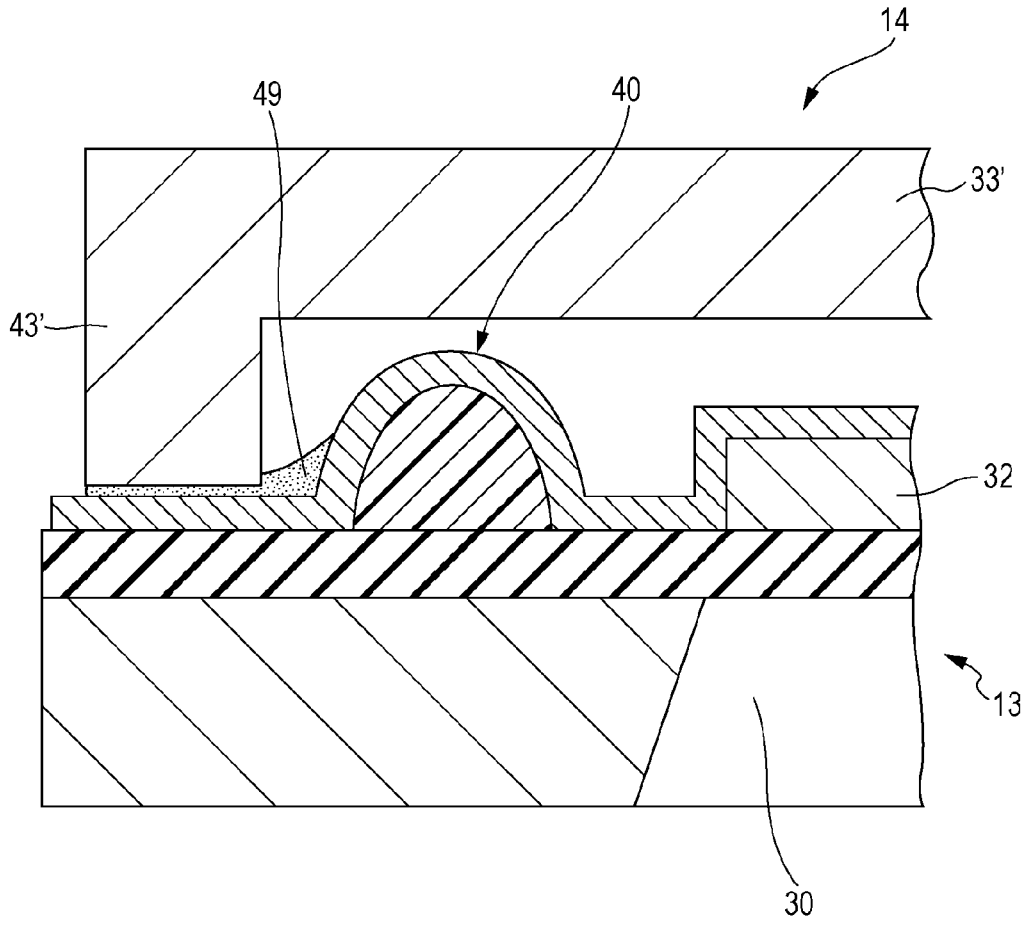
FIG. 9 is an enlarged sectional view of a main part of an electronic device in a third embodiment.

Furthermore, in the embodiment, as the spacer for forming a gap between the sealing plate 33 and the actuator substrate 13, the spacer 43 made of photopolymer, which is formed on the sealing plate 33 is exemplified. However, the embodiment is not limited thereto. For example, in the third embodiment illustrated in FIG. 9, a sealing plate 33' includes a side wall 43'. The side wall 43' functions as the spacer in the invention. Each side wall 43' is protruded from the four sides of the edge of the sealing plate 33' to the actuator substrate 13 side. By bonding a distal end surface of the side wall 43' and the actuator substrate 13 by the adhesive 49, a gap is formed between a main body (base substrate) of the sealing plate 33' and the actuator substrate 13. In the embodiment, the adhesion region between the side wall 43' of the sealing plate 33' and the actuator substrate 13 are formed only facing the drive region while pinching the bump electrode 40, and the adhesion region is not provided on the drive region side compared to the bump electrode 40. Therefore, it is possible to closely implement the drive region to the bump electrode 40. With this, it is possible to further implement the miniaturization of the electronic device 14. Another configuration is the same as the first embodiment.

Furthermore, in the embodiment, as the electronic device 14 according to the invention, a configuration where ink that is a type of liquid is ejected from a nozzle by driving of the piezoelectric element 32 as a drive element is exemplified. However, the embodiment is not limited thereto. In a case of an electronic device in which the first substrate and the second substrate are bonded by the adhesive by interposing the spacer, it is possible to apply the invention thereto. For example, it is also possible to apply the invention to an electronic device or the like used in a sensor for detecting driving, displacement, or the like by the drive element.

In addition, as described above, an ink jet recording head mounted in an ink jet printer is exemplified as the liquid ejecting head. However, it is also possible to apply a device for ejecting liquid other than the ink. It is also possible to apply the invention to, for example, a color material ejecting head used for manufacturing a color filter such as a liquid crystal display and the like, an electrode material ejecting head used for forming an electrode of the field emitting display (FED), an organic electro luminescence (EL) display, or the like, a bio-organic material jet head used for manufacturing a bio-chip (biological and chemical element), or the like.

What is claimed is:

1. An electronic device comprising:

a first substrate including a structure body protruded from one surface; and a second substrate stacked and disposed facing the one surface through a spacer, wherein the structure body protrudes towards a surface of the second substrate that includes the spacer, wherein the first substrate and the spacer are bonded to each other by an adhesive, and wherein the adhesive is extended up to the structure body along the one surface.

2. The electronic device according to claim 1, wherein a static contact angle of the adhesive with respect to the structure body is equal to or less than 90°, and wherein the static contact angle of the adhesive with respect to the first substrate is smaller than the static contact angle of the adhesive with respect to the structure body.

3. A liquid ejecting head comprising:

the electronic device according to claim 2, wherein a piezoelectric element for generating pressure variation to liquid within a pressure chamber formed on the first substrate by driving the drive region is provided, wherein the structure body includes a curved surface curved on the second substrate side, and wherein a metal layer related to driving of the piezoelectric element is formed on the curved surface.

4. The electronic device according to claim 1, wherein the adhesive is non-conductive.

5. A liquid ejecting head comprising:

the electronic device according to claim 4, wherein a piezoelectric element for generating pressure variation to liquid within a pressure chamber formed on the first substrate by driving the drive region is provided, wherein the structure body includes a curved surface curved on the second substrate side, and wherein a metal layer related to driving of the piezoelectric element is formed on the curved surface.

6. The electronic device according to claim 1, wherein the first substrate includes a drive region on the one surface, and wherein the structure body and the spacer are formed at a position outside the drive region.

7. A liquid ejecting head comprising:

the electronic device according to claim 6, wherein a piezoelectric element for generating pressure variation to liquid within a pressure chamber formed on the first substrate by driving the drive region is provided, wherein the structure body includes a curved surface curved on the second substrate side, and wherein a metal layer related to driving of the piezoelectric element is formed on the curved surface.

8. The electronic device according to claim 1, wherein the spacer is provided between the drive region and the structure body.

9. A liquid ejecting head comprising:

the electronic device according to claim 8, wherein a piezoelectric element for generating pressure variation to liquid within a pressure chamber formed on the first substrate by driving the drive region is provided, wherein the structure body includes a curved surface curved on the second substrate side, and wherein a metal layer related to driving of the piezoelectric element is formed on the curved surface.

10. A liquid ejecting head comprising:

the electronic device according to claim 1, wherein a piezoelectric element for generating pressure variation to liquid within a pressure chamber formed on the first substrate by driving the drive region is provided, wherein the structure body includes a curved surface curved on the second substrate side, and wherein a metal layer related to driving of the piezoelectric element is formed on the curved surface.

* * * * *